US006284992B1

(12) United States Patent
Richter

(10) Patent No.: US 6,284,992 B1
(45) Date of Patent: Sep. 4, 2001

(54) KEY FOR A KEYBOARD

(75) Inventor: Hans Richter, Ortlerstrasse (DE)

(73) Assignee: Rafi GmbH & Co. Elektrotechnische Spezialfabrik, Ravensburg (DE)

( * ) Notice: Subject to any disclaimer, the term of this patent is extended or adjusted under 35 U.S.C. 154(b) by 0 days.

(21) Appl. No.: 09/381,652

(22) PCT Filed: Jan. 20, 1999

(86) PCT No.: PCT/EP99/00313

§ 371 Date: Sep. 20, 1999

§ 102(e) Date: Sep. 20, 1999

(87) PCT Pub. No.: WO99/38180

PCT Pub. Date: Jul. 29, 1999

(30) Foreign Application Priority Data

Jan. 22, 1998 (DE) ..... 198 02 292

(51) Int. Cl.[7] ..... H01H 13/70
(52) U.S. Cl. ..... 200/344; 200/345
(58) Field of Search ..... 200/5 A, 341, 200/344, 345, 517; 400/490, 491.2, 495, 495.1, 496

(56) References Cited

U.S. PATENT DOCUMENTS 4,251,703 * 2/1981 Hoeft et al. ..... 200/340
5,120,923 * 6/1992 Kato et al. ..... 200/520
5,203,448 * 4/1993 Osada et al. ..... 200/517
5,306,886 * 4/1994 Yamada ..... 200/517
5,386,091 * 1/1995 Clancy ..... 200/517
5,626,223 5/1997 Lee ..... 200/529

FOREIGN PATENT DOCUMENTS 0499449 8/1992 (EP) .
0777246 6/1997 (EP) .

* cited by examiner

*Primary Examiner*—Paula Bradley
*Assistant Examiner*—Nhung Nguyen
(74) *Attorney, Agent, or Firm*—Pandiscio & Pandiscio

(57) ABSTRACT

A key for a keyboard consisting of a base part (1) with a recess (7), an intermediate part (2), a key head (3) and an elastic return part (4). The cylindrical intermediate part (2) is arranged between the bottom part (14) of the key head (3) and the recess (7), with the intermediate part (2) moving into the recess (7) when the key head (3) is pressed. The intermediate part (2) is in a screw-like engagement with the bottom part (14) of the key head (3) and with the recess (7) in each case, with the one engagement running in the opposite direction to the other engagement.

12 Claims, 1 Drawing Sheet

A-A

A-B

KEY FOR A KEYBOARD

Key of this type are used, for example, on the keyboards of notebook computers. In this case, the return part is made of an elastically deformable material and has a pot shape. A contact point is provided in the centre and, when the key is pressed, this contact point makes contact with a conductor pathway on a printed circuit board upon which the base part is arranged. The wall of the return part is deformed in an S-shape when the key is pressed. The bottom part of the key head is guided in a recess in the base part. This guide must ensure that the key head can be pressed without tilting, since otherwise there is no guarantee that the key will make contact. Due to this guide, the bottom part of the key head is relatively long and the recess in the base part is relatively deep.

The purpose of the present invention is to make a flat key which guarantees that the key head can be pressed without tilting.

Figure 1:
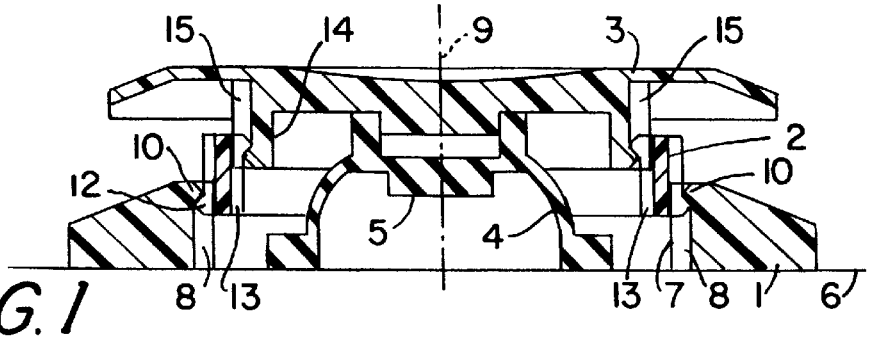
Figure 2:
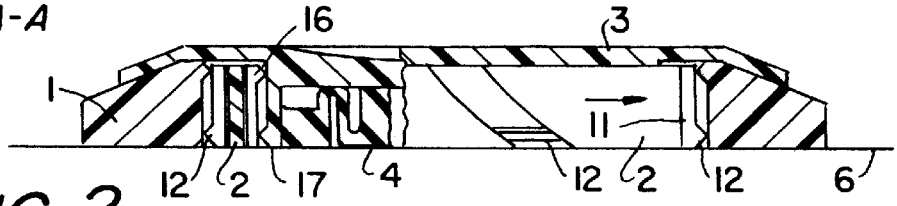
Figure 3:
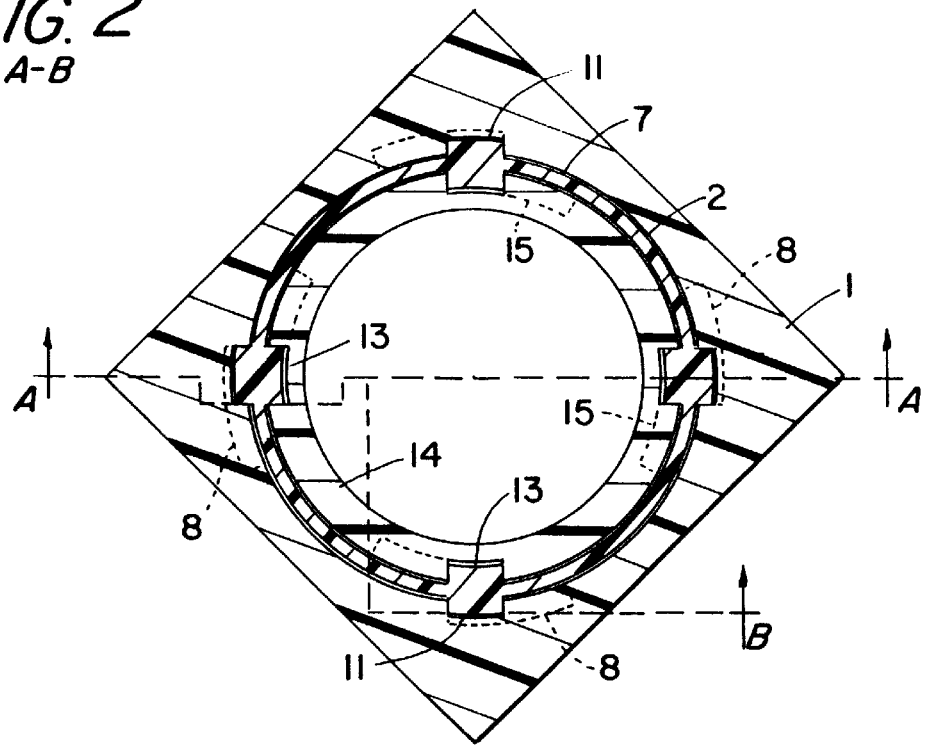
Figure 4:
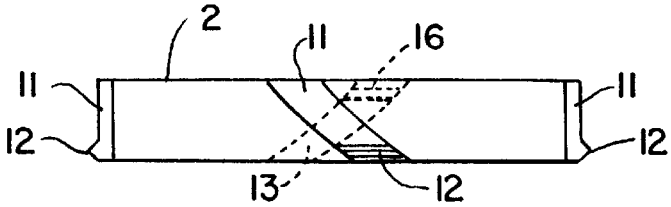

A sample embodiment of the key configured in accordance with the present invention is explained in more detail below by means of the drawings. In the drawings, FIG. 1 shows a vertical section through the key which is not pressed, along the line A—A in FIG. 3, FIG. 2 shows a vertical section through the key which is pressed, along the line A–B in FIG. 3, FIG. 3 shows a horizontal section through the key in accordance with FIG. 1, and FIG. 4 shows the intermediate part of the key in accordance with FIG. 1, in a side view.

The key consists of four parts, namely the base part 1, an intermediate part 2, a key head 3 and a return part 4.

The return part 4 has a pot shape and is made of an elastically deformable material. A contact surface 5 is arranged centrally at the bottom on a projection which points downwards. When the key is pressed, this comes into contact with a printed circuit board 6 upon which the base part 1 is arranged.

The base part 1 has a round cylindrical recess 7. Four grooves 8 are formed on the wall of the recess 7 running at an angle to the key axis 9. A projection 10 is formed onto the top end of each of these grooves 8.

The intermediate part 2 is formed as a round cylinder. Four springs 11 are provided on the outside of the intermediate part 2 at an angle corresponding to the inclination of the grooves 8. Each of the springs 11 has a projection 12 at its bottom end. The springs 11 engage with the grooves 8. When the key is not pressed, the projections 10, 12 are in contact with one another as shown in FIG. 1.

Four further springs 13 are formed onto the inside circumference of the intermediate part 2 and also run at an angle to the key axis 9. The angle of the springs 13 is opposite to the inclination of the springs 11.

The bottom part of the key head 3 has a circular ring cross-section. The wall of the bottom part 14 has four grooves 15. The grooves 15 run at the same angle as the springs 13 which engage in the grooves 15.

When the key head 3 is pressed down, the engagement between the grooves 15 and the springs 13, as well as the engagement between the grooves 8 and the springs 11 leads to the intermediate part 2 describing a rotary movement because of the opposite inclinations. This rotary movement is shown by the arrow in FIG. 2. This rotary movement also takes place when the key head 3 is only pressed at its edge. The linear movement of the key head 3 is therefore translated into a rotary movement of the intermediate part 2. Due to the opposite inclinations of the grooves and springs 11 in relation to the grooves 8 and springs 13, the key head 3 does not move relative to the base part 1.

Grooves 8 or 15 and springs 11 or 13 have, in a preferred embodiment, a spiral track.

The downwards movement of the key head 3 is also limited by projections 16, 17 which are provided in the upper area of springs 13 and in the lower area of grooves 15.

What is claimed is:

1. A key assembly for a keyboard, the key assembly comprising a key head (3) having a bottom cylindrical part (14), a base part (1) having a recess (7) therein, and an elastically deformable return part (4) disposed in the recess and arranged between said key head and said base part, the bottom cylindrical part (14) of said key head (3) being movable axially into the recess (7) when said key head (3) is pressed down against a force of said return part (4), and a cylindrical intermediate part (2) arranged between the bottom cylindrical part (14) of said key head (3) and a wall of the base part recess (7), said cylindrical intermediate part (2) being movable axially and rotatively into the recess (7) when said key head (3) is pressed, the bottom cylindrical part (14) of said key head (3) and said intermediate part (2) engaging rotatively, and said intermediate part (2) and the base part recess wall (7) engaging rotatively, in a screw-like fashion with one rotative engagement running in an opposite direction to the other rotative engagement.

2. The key assembly in accordance with claim 1, wherein the rotative engagements are formed by groove/projection connections (8; 11; 15; 13) extending at an angle to a key assembly axis (9).

3. The key assembly in accordance with claim 2, wherein projections are formed on said base part (1), and grooves are formed in the intermediate part (2) to receive the projections.

4. The key assembly in accordance with claim 2 wherein grooves (15) are formed in the bottom part (14) of said key head (3), and projections are formed on the intermediate part (2) to engage in the grooves (15).

5. The key assembly in accordance with claim 4, wherein the grooves (15) in the bottom part (14) are formed as slots extending into a wall of the bottom part (14).

6. The assembly in accordance with claim 2, wherein at least three of said groove/projection connections (8; 11; 15; 13) are provided between the intermediate part (2) and the bottom part (14) of the key head (3) on one hand and the base part (1) on the other hand.

7. The key assembly in accordance with claim 1, wherein a height of said intermediate part (2) substantially corresponds to a height of the bottom part (14) of said key head (3).

8. The key assembly in accordance with claim 7, wherein the height of said intermediate part (2) substantially corresponds to a depth of the recess (7).

9. The key assembly in accordance with claim 1, wherein stops are provided between said intermediate part (2) and the recess (7) and between said intermediate part and the bottom part (14) of said key head (3), which stop movement of said key head (3), and said intermediate part (2) in a direction of force of the return part (4).

10. The key assembly in accordance with claim 9, wherein said stops between the recess (7) and said intermediate part (2) are formed by projections (10) formed proximate a top side of the recess (7) and by projections (12) formed on said intermediate part (2).

11. The key assembly in accordance with claim 9 wherein said stops between said intermediate part (2) and the bottom part (14) of said key head (3) are formed by projections on the intermediate part (2) and by slot ends on the bottom part (14) of said head (3).

12. The key assembly in accordance with claim 10 wherein the projections (10; 12) are received by ends of the grooves (8; 15).

* * * * *